US008890410B2

(12) United States Patent
Ikeda et al.

(10) Patent No.: US 8,890,410 B2
(45) Date of Patent: Nov. 18, 2014

(54) PLASMA GENERATION DEVICE

(71) Applicant: Imagineering, Inc., Kobe (JP)

(72) Inventors: Yuji Ikeda, Kobe (JP); Hitoe Kaneko, Kobe (JP); Motoki Kawashima, Kobe (JP)

(73) Assignee: Imagineering, Inc., Kobe-shi (JP)

( * ) Notice: Subject to any disclaimer, the term of this patent is extended or adjusted under 35 U.S.C. 154(b) by 13 days.

(21) Appl. No.: 13/665,313

(22) Filed: Oct. 31, 2012

(65) Prior Publication Data

US 2013/0057145 A1 Mar. 7, 2013

Related U.S. Application Data

(63) Continuation of application No. 13/496,534, filed as application No. PCT/JP2010/066261 on Sep. 17, 2010, now abandoned.

(30) Foreign Application Priority Data

Sep. 17, 2009 (JP) ..... 2009-216275

(51) Int. Cl.
*H01Q 1/26* (2006.01)
*H05H 1/46* (2006.01)

(52) U.S. Cl.
CPC ..... *H05H 1/46* (2013.01); *H05H 2001/463* (2013.01)
USPC ..... 315/34; 315/111.21; 315/111.41; 315/111.51; 118/723 MW

(58) Field of Classification Search
USPC ..... 315/34, 111.21–111.51
See application file for complete search history.

(56) References Cited

U.S. PATENT DOCUMENTS 7,183,514 B2 * 2/2007 Kamarehi ..... 219/121.43
7,582,569 B2 * 9/2009 Ohmi et al. ..... 438/728
7,728,251 B2 * 6/2010 Ide et al. ..... 219/121.43

(Continued)

FOREIGN PATENT DOCUMENTS

JP 1988-119198 A 5/1988
JP 1994-101051 A 4/1994

(Continued)

OTHER PUBLICATIONS

International Search Report of PCT/JP2010/066261, mailing date of Nov. 9, 2010.

*Primary Examiner* — Douglas W Owens
*Assistant Examiner* — Srinivas Sathiraju
(74) *Attorney, Agent, or Firm* — Westerman, Hattori, Daniels & Adrian, LLP

(57) ABSTRACT

A plasma generation device, including: an ionization unit that ionizes gas in a target space; an electromagnetic wave oscillator that oscillates an electromagnetic wave to be radiated to the target space; and an antenna that radiates the electromagnetic wave supplied from the electromagnetic wave oscillator to a gas ionization region in which gas ionized by the ionization unit is provided. The ionization unit ionizes gas and the antenna radiates the electromagnetic wave thereto to generate plasma. A plurality of strong electric field regions are formed around the antenna when the electromagnetic wave is supplied from the electromagnetic wave oscillator. The strong electric field region is a region stronger in electric field than the surrounding area. The ionization unit ionizes gas around the plurality of strong electric field regions, or gas around a plurality of regions in which immediately before strong electric fields come into existence.

9 Claims, 3 Drawing Sheets

(56) References Cited

U.S. PATENT DOCUMENTS

| | | | | |
|---|---|---|---|---|
| 7,872,406 | B2 * | 1/2011 | Matacotta | 313/231.31 |
| 8,169,148 | B2 * | 5/2012 | Jeon et al. | 315/111.21 |
| 8,179,050 | B2 * | 5/2012 | Chen | 315/111.41 |
| 8,216,420 | B2 * | 7/2012 | Kazumi et al. | 156/345.41 |
| 8,308,898 | B2 * | 11/2012 | Kasai et al. | 156/345.41 |
| 2010/0095888 | A1 * | 4/2010 | Mori et al. | 118/663 |

FOREIGN PATENT DOCUMENTS

| | | | |
|---|---|---|---|
| JP | 2004-152940 | A | 5/2004 |
| JP | 2006-152418 | A | 6/2006 |
| JP | 2007-113570 | A | 5/2007 |
| JP | 2009-34674 | A | 2/2009 |
| JP | 2009-38025 | A | 2/2009 |

* cited by examiner

PLASMA GENERATION DEVICE

CROSS-REFERENCE TO RELATED APPLICATION

This application is a Continuation of application Ser. No. 13/496,531, filed Mar. 16, 2012. Application Ser. No. 13/496,531 is a National Stage application of PCT/JP2010/066261, filed Sep. 17, 2010, which is based upon and claims the benefit of priority of the prior Japanese Patent Application No. 2009-216275, filed on Sep. 17, 2009, the entire contents of which are incorporated herein by reference.

TECHNICAL FIELD

The present invention relates to a plasma generation device that radiates an electromagnetic wave to a region in which gas is ionized.

BACKGROUND ART

Conventionally, there is known a plasma generation device that radiates an electromagnetic wave to a region in which gas is ionized. Such a plasma generation device can be used for decomposing and detoxifying various air pollutants such as VOC (volatile organic compounds).

The inventors have proposed a plasma generation device that simultaneously employs electric discharge and microwave radiation (Patent Documents 1 and 2). For example, the gas treatment device disclosed in Patent Document 2 generates a small-scale plasma by means of spark discharge and radiates microwave pulses to the plasma. The energy of the microwave pulses is supplied to the charged particles in the plasma, thereby enlarging and growing the plasma.

PATENT DOCUMENTS

Patent Document 1: Japanese Unexamined Patent Application, Publication No. 2007-113570

Patent Document 2: Japanese Unexamined Patent Application, Publication No. 2009-034674

THE DISCLOSURE OF THE INVENTION

Problems to be Solved by the Invention

There may be a need to generate plasmas at a plurality of locations. However, conventional plasma generation devices can generate plasma only at one location using one antenna. Consequently, an attempt to generate plasmas at a plurality of locations will make the device configuration complicated.

The present invention has been made in view of the above-mentioned facts, and it is an object of the present invention to realize generation of plasmas at a plurality of locations with a simple structure, in a plasma generation device that radiates an electromagnetic wave to a region in which gas is ionized.

Means for Solving the Problems

A first aspect of the present invention is a plasma generation device, comprising: an ionization unit that ionizes gas in a target space; an electromagnetic wave oscillator that oscillates an electromagnetic wave to be radiated to the target space; and an antenna that radiates the electromagnetic wave supplied from the electromagnetic wave oscillator to a gas ionization region in which gas ionized by the ionization unit is provided, in which the ionization unit ionizes gas and the antenna radiates the electromagnetic wave thereto to generate plasma, wherein a plurality of strong electric field regions are formed around the antenna when the electromagnetic wave is supplied from the electromagnetic wave oscillator, the strong electric field region being a region stronger in electric field than the surrounding area, and the ionization unit ionizes gas around the plurality of strong electric field regions, or gas around a plurality of regions in which immediately before strong electric fields come into existence.

In accordance with a first aspect of the present invention, when an electromagnetic wave is supplied to an antenna from an electromagnetic wave oscillator, a plurality of strong electric field regions are formed around the antenna. An ionization unit ionizes gas around the plurality of strong electric field regions or around a plurality of regions in which immediately before strong electric fields come into existence. As a result thereof, since charged particles in a gas ionization region receives energy of the electromagnetic wave from the strong electric field regions, relatively large plasmas are generated in the gas ionization regions. Also, in a case of ionizing gas around the plurality of regions in which immediately before strong electric fields come into existence, the strong electric field regions are formed by the electromagnetic wave immediately after the gas is ionized, charged particles receive energy of the electromagnetic wave from the strong electric field regions, and relatively large-scale plasmas are generated. Thus, in accordance with the first aspect of the present invention, it is possible to generate plasmas at a plurality of locations using one antenna.

Effects of the Invention

A second aspect of the present invention is a plasma generation device as set forth in claim 1, wherein the antenna is formed with a plurality of changeable portions changeable in at least one of shape or dimension, and a strong electric field region is formed in the vicinity of the changeable portions.

A third aspect of the present invention is a plasma generation device as set forth in claim 2, wherein the antenna is in the form of a rod shape formed with a plurality of flexure portions as the changeable portions.

A forth aspect of the present invention is a plasma generation device as set forth in claim 2, wherein the antenna is a rod-shaped antenna formed with a plurality of diameter changeable portions as the changeable portions.

A fifth aspect of the present invention is 5. A plasma generation device as set forth in any one of claims 2 to 4, wherein a distance between adjacent changeable portions is within a range from an approximately ½ to an approximately ¾ wave length of the electromagnetic wave in the antenna.

A sixth aspect of the present invention is a plasma generation device as set forth in claim 3, wherein the antenna is formed in a square wave shape.

A seventh aspect of the present invention is a plasma generation device as set forth in claim 6, wherein a plurality of the antennas are arranged, and flexure portions of respective antennas are shifted out of alignment from one another in the direction in which square waves run.

A eighth aspect of the present invention is a plasma generation device as set forth in any one of claims 1 to 7, wherein the ionization unit includes a plurality of electric dischargers, disposed corresponding to the plurality of strong electric field regions or the plurality of regions in which immediately before strong electric fields come into existence, and discharges around the regions.

A ninth aspect of the present invention is a plasma generation device as set forth in claim 8, wherein the ionization unit delays timing of discharging among the plurality of electric dischargers.

A tenth aspect of the present invention is a plasma generation device as set forth in any one of claims 1 to 7, wherein the ionization unit includes a laser radiator that radiates a laser beam to the plurality of strong electric field regions or the plurality of regions in which immediately before strong electric fields come into existence, so as to ionize gas.

A eleventh aspect of the present invention is a plasma generation device as set forth in any one of claims 1 to 10, further comprising a drive unit that moves the antenna.

According to the present invention, it is possible to generate plasmas at a plurality of locations using one antenna. Accordingly, it is possible to realize generation of plasma at a plurality of locations with a simple structure.

BEST MODE FOR CARRYING OUT THE INVENTION

In the following, a detailed description will be given of preferred embodiments of the present invention with reference to drawings. It should be noted that the following embodiments are mere examples that are essentially preferable, and are not intended to limit the scope of the present invention, applied field thereof, or application thereof.

Here, before the description of embodiments, a description will be given of a result acquired by the inventors of a simulation of electric field distribution. The simulation has been performed by means of numerical calculation of electric field distribution in the case of an antenna configured by a single metal rod formed in a square wave shape. The calculation result is shown in FIG. 1.

Figure 1:
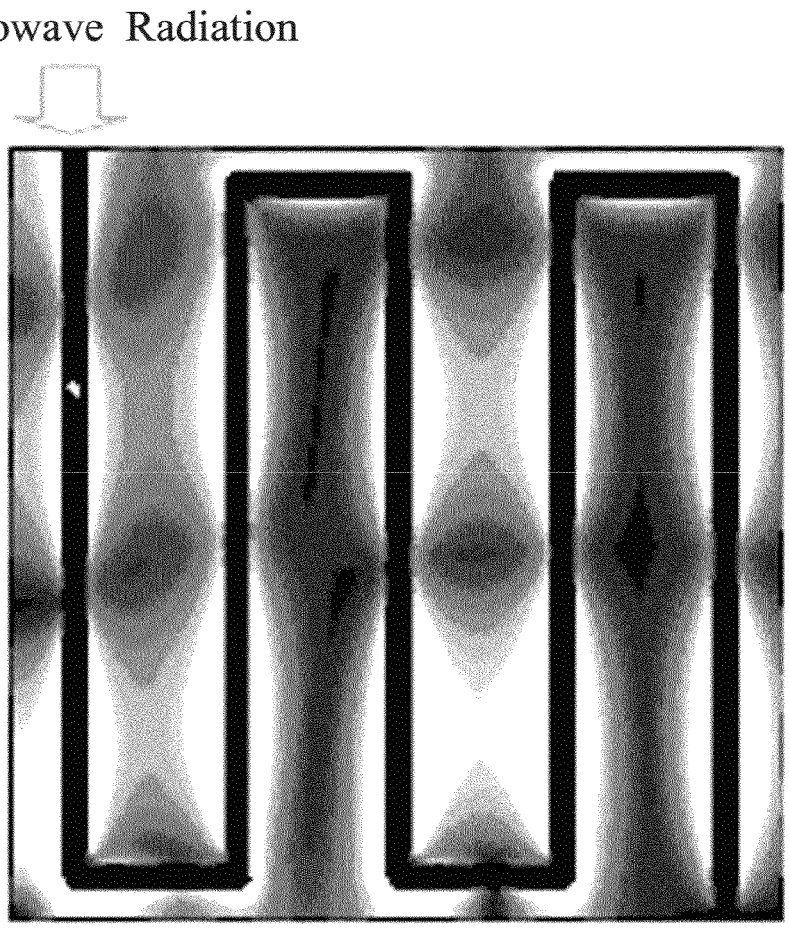
FIG. 1 is a view showing a result of simulating an electric field.

As shown in FIG. 1, it was found that the metal rod generates an electric field distribution such that the electric fields are intensified at every ½ wave length of the electromagnetic wave, and, further, the electric fields are concentrated and intensified at flexure portions of the metal rod and thus form strong electric fields in comparison with the electric fields in surrounding areas.

Also, it was found that the electric fields are intensified, not only at a ½ wave length of the electromagnetic wave, but also in a range from a ½ wave length to a ¾ wave length as well.

<First Embodiment>

Figure 4:
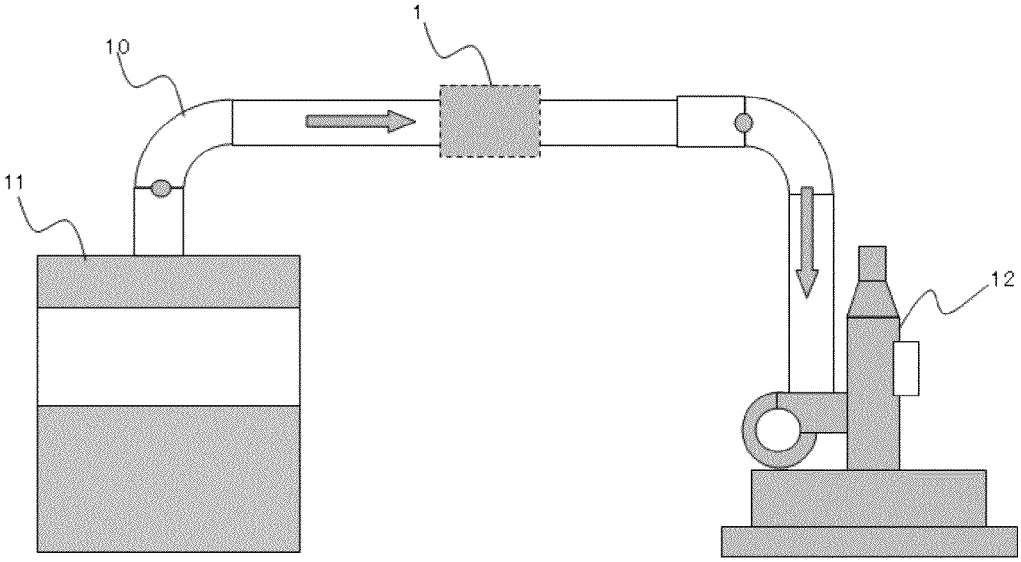
FIG. 4 is a view showing a spatial configuration of a gas treatment device according to the present invention.

In the following, a description will be given of a first embodiment with reference to drawings. The first embodiment is a gas treatment device 1 configured by the plasma generation device according to the present invention. The gas treatment device 1 is an example of the present invention. As shown in FIG. 4, the gas treatment device 1 is disposed, for example, along with a reaction chamber in the middle of an exhaust air duct 10 that serves as a flow path of an exhaust gas from a draft chamber 11. The exhaust gas, passing through the exhaust air duct 10, is finally guided to an external treatment device 12.

In the middle of the exhaust air duct 10, the gas treatment device 1 oxidizes various organic compounds such as aromatic organic compounds and aldehydes in the exhaust gas, utilizing plasma, heat of the plasma, and powerful oxidizing active ingredients generated from the plasma, and finally reforms them to carbon dioxide and water, thereby detoxifying toxic substances therein. More specifically, the powerful oxidizing active ingredients mean ingredients such as OH radical and ozone, produced as a result of treating oxygen or water in the air with non-equilibrium plasma.

Figure 2:
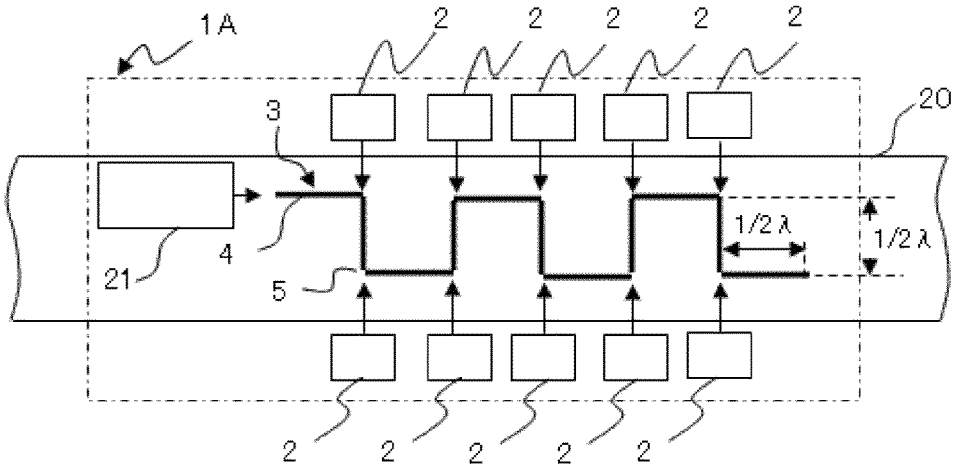
FIG. 2 is a schematic view illustrating a configuration of a first embodiment according to the present invention.

FIG. 2 shows a gas treatment device 1A of the first embodiment. In FIG. 2, gas inflow and outflow units serving as a gas flow path, composed of fans or the like and disposed in a duct, are omitted.

As shown in FIG. 2, the gas treatment device 1A of the first embodiment is arranged in a reaction chamber 20 in the middle of an exhaust air duct 10. The gas treatment device 1A includes a plurality of plasma generators 2 and an electromagnetic wave radiator 3.

Each plasma generator 2 generates a small-scale plasma by way of spark discharge. The plurality of plasma generators 2 constitute an ionization unit that ionizes gas in a target space. A region where the small-scale plasma is generated corresponds to a gas ionization region in which gas ionized by the ionization unit is provided. The ionization unit ionizes gas around a plurality of strong electric field regions, which will be described later, or gas around a plurality of regions in which immediately before strong electric fields come into existence. The plasma generators 2 are disposed respectively corresponding to the plurality of strong electric field regions or the plurality of regions in which immediately before strong electric fields come into existence. The plasma generators 2 constitute an electric discharger that discharges electric current around the regions.

As the plasma generator 2, for example, a spark plug for automotive application or the like can be employed. In this case, the gas treatment device 1 can be produced at low cost.

The electromagnetic wave radiator 3 radiates electromagnetic waves (microwave pulses) to the small-scale plasmas generated by the plurality of plasma generators 2. The electromagnetic wave radiator 3 includes an electromagnetic wave oscillator 21 (electromagnetic wave control and power unit) and an antenna 4. The electromagnetic wave oscillator 21 oscillates an electromagnetic wave to be radiated to the reaction chamber 20, which is the target space. The electromagnetic wave oscillator 21 is connected to a tip of the antenna 4 and applies the electromagnetic wave to the antenna 4.

In the present embodiment, a microwave of 2.45 GHz is selected as the electromagnetic wave. Accordingly, a magnetron for domestic use can be employed. As a result thereof, the gas treatment device 1A can be produced at low cost. In a case in which the electromagnetic wave is of 2.45 GHz, ½ wave length is approximately 60 mm, and ¾ wave length is approximately 90 mm.

The antenna 4 is a square-wave-shaped metal rod having a plurality of flexure portions 5 (changeable portions that can be changed in shape). The antenna 4 is provided so to be exposed inside the reaction chamber 20. The antenna 4 is bent approximately equidistantly and thus configured in a square wave shape. In the antenna 4, the distance between adjacent flexure portions 5 coincides with a half wave length of the electromagnetic wave (microwave pulse) that flows therethrough. It may suffice that the distance between adjacent flexure portions 5 is within a range from an approximately ½ to an approximately ¾ wave length of the electromagnetic wave that flows therethrough.

When an electromagnetic wave is supplied to the antenna 4 from the electromagnetic wave oscillator 21, each flexure portion 5 forms a strong electric field region, which is a region stronger in electric field than the surrounding area. Thus, the strong electric field region is formed plural in number. When the electromagnetic wave is supplied to the antenna 4 from the electromagnetic wave oscillator 21, if the electromagnetic wave is adjusted with respect to the phase and the like such that the antinodes of the electromagnetic wave are just located at the flexure portions 5, then the electric fields becomes further stronger at the flexure portions 5.

The operation of the gas treatment device 1 will be described hereinafter. The gas treatment device 1 generates plasma for gas treatment in the following two steps, for example.

First, the plasma generators 2 produce spark discharge. Small-scale plasmas are generated by the spark discharge in the reaction chamber 20. Then, the antenna 4 radiates electromagnetic waves oscillated by the electromagnetic wave oscillator 21 to the small-scale plasmas. The electromagnetic wave radiated from the antenna 4 energizes charged particles in the plasmas, thereby assisting the plasmas in enlarging and growing.

At this time, the duration of microwave pulses and the number of times of plasma treatment are adjusted in accordance with components and densities thereof in the gas to be treated. With regard to adjusting microwave pulses, for example, the duration of the microwave pulses may be adjusted so as to selectively generate non-equilibrium plasma and thermal equilibrium plasma or to control the temperature of the plasma. Also, for example, the number of times of microwave pulses to be radiated per unit time may adjusted so as to control the throughput.

The timing of turning gas into plasma may be delayed among the plurality of plasma generators 2. For example, the plurality of plasma generators 2 may sequentially turn gas into plasma in a predetermined cycle. In such a case, since each plasma absorbs more energy from the electromagnetic waves, the plasma will expand larger, in comparison with the case in which the plurality of plasma generators 2 simultaneously turn gas into plasma.

The electromagnetic wave oscillator 21, upon receiving power supplied from a pulsed power supply, oscillates electromagnetic waves and then repeats such oscillating and stop operations with a predetermined duty ratio. Plasmas sustained by the electromagnetic waves remain non-equilibrium without the plasmas becoming thermal.

<Effect of First Embodiment>

In the first embodiment, the plasma generators 2 are disposed in the vicinity of respective flexure portions 5 of the antenna 4. This means that each plasma generator 2 is disposed on the side of a standing wave antinode on the antenna 4. In view of the fact that the electric fields can be concentrated at the flexure portions 5 of the antenna 4 to which the electromagnetic waves are applied, the plasma generators 2 of the first embodiment are disposed in the vicinity of the respective flexure portions 5. Accordingly, regions in which plasmas are generated can be expanded effectively.

<First Modification of First Embodiment>

Figure 3:
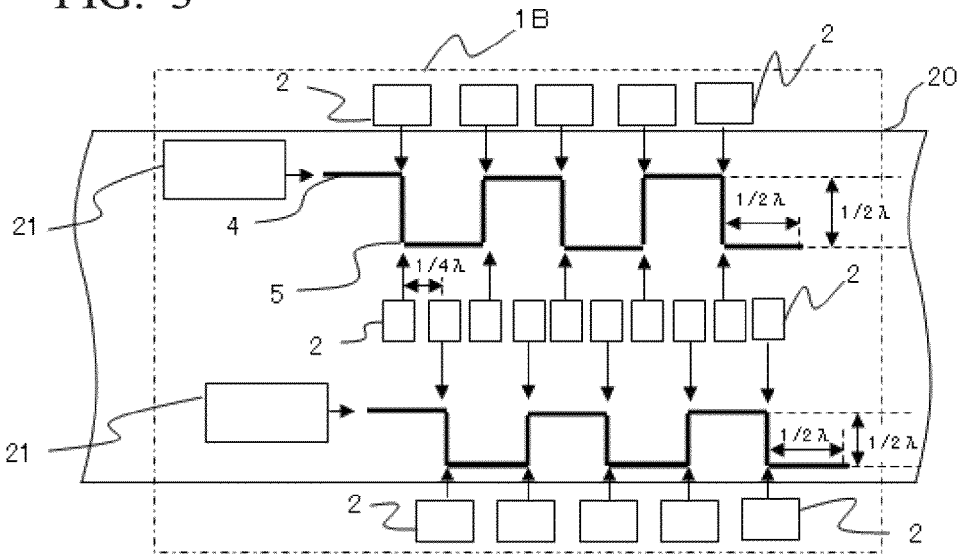
FIG. 3 is a schematic view illustrating a configuration of a first modification of the first embodiment according to the present invention.

In the following, a description will be given of a first modification with reference to FIG. 3. In the first modification, there are provided two antennas 4 configured by metal rods. Similar to the first embodiment, plasma generators 2 are disposed in the vicinity of respective flexure portions 5 of both of the antennas 4.

In the first modification, each antenna 4 is arranged in such a manner that a direction of the antenna 4 (longitudinal direction of the antenna 4), in which the square waves run, coincides with a direction in which gas flows. The two antennas 4 are arranged adjacently to each other. The flexure portions 5 of two respective antennas 4 are shifted out of alignment from one another in the direction in which the square waves run. The shift amount of the flexure portions 5 in the direction in which the square waves run is set to an approximately ¼ wave length of the electromagnetic wave applied to the antennas 4.

Therefore, plasma generation regions where plasmas are generated will not interfere with each other. Accordingly, the volumes of the plasma generation regions are enlarged, in comparison with the case in which the plasma generation regions would interfere with each other. As a result thereof, it becomes possible for the greater amount of gas to be held in contact with plasma, and the efficiency of the gas treatment can be enhanced.

<Second Modification of First Embodiment>

In the following, a description will be given of a second modification with reference to FIG. 5. In the second modification, an antenna 4 is configured in the form of a triangle wave shape. A plurality of electric dischargers 156 are arranged in a gas flow direction on an inner wall of a gas flow path 110 in a manner facing toward flexure portions 5 of the antenna 4. Each electric discharger 156 is located such that a discharge gap between a discharge electrode 156*a* and a ground electrode 156*b* thereof is formed around each flexure portion 5.

In the second modification, it is possible to provide a drive unit 95 that moves the antenna 4. The drive unit 95 is configured by a motor 95 that rotates the antenna 4. In this case, a pair of adjacent electric dischargers 156 in a gas flow direction are shifted out of alignment from each other in a circular direction. During the rotation of the antenna 4, each electric discharger 156 discharges when the flexure portion 5 comes in the vicinity thereof.

Figure 5:
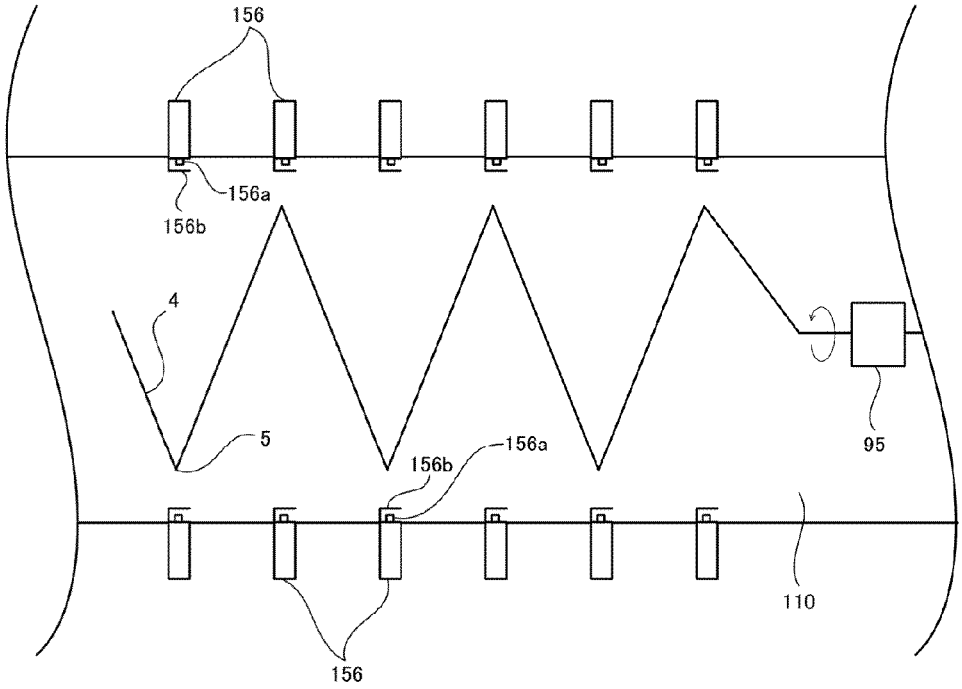
FIG. 5 is a schematic view illustrating a configuration of a second modification of the first embodiment according to the present invention.

The drive unit 95 may reciprocally move the antenna 4 (for example, in an up-down direction or a left-right direction in FIG. 5).

<Second Embodiment >

In the following, a description will be given of a second embodiment with reference to drawings. The second embodiment is a gas treatment device 1 configured by a plasma generation device according to the present invention.

Figure 6:
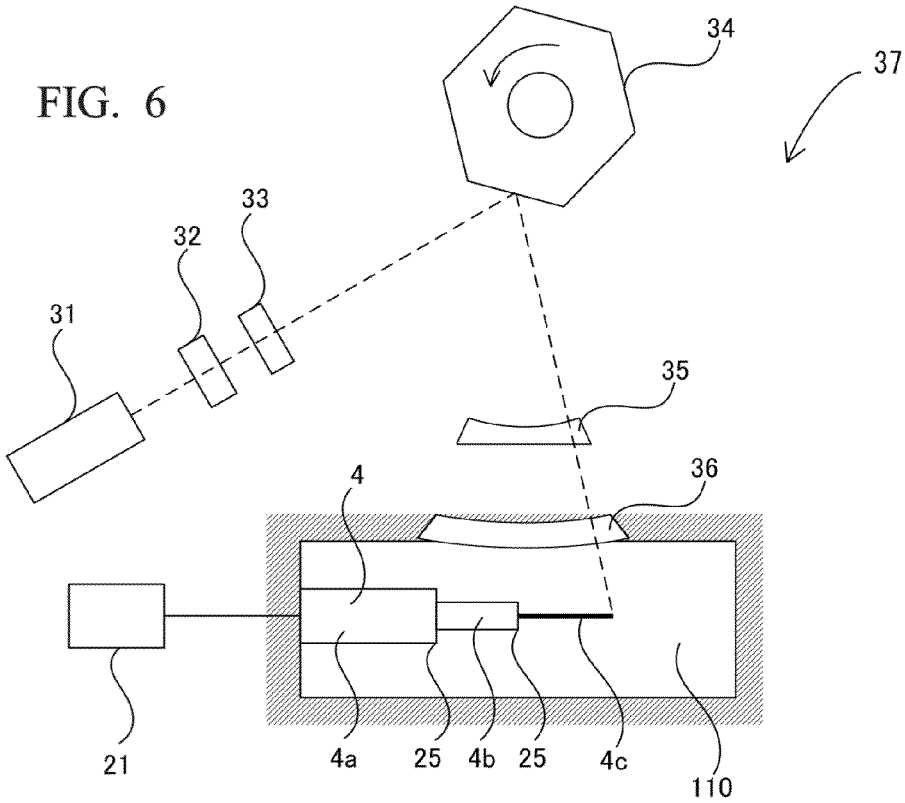
FIG. 6 is a schematic view illustrating a configuration of a second embodiment according to the present invention.

In the second embodiment, as shown in FIG. 6, diameter changeable portions 25 are provided at two locations of the antenna 4. When an electromagnetic wave is supplied from an electromagnetic wave oscillator 21 to the antenna 4, strong electric field regions are formed in the vicinity of the diameter changeable portions 25. Also, another strong electric field region is formed around a tip of the antenna 4. Thus, the strong electric field regions are formed at three locations around the antenna 4.

In the second embodiment, the ionization unit is configured by a laser radiator 37 that radiates a laser beam to a plurality of strong electric field regions or a plurality of regions in which immediately before strong electric fields come into existence. The laser radiator 37 includes an oscillator 31 (for example, a semiconductor laser) that oscillates a laser beam, a collimating lens 32, a cylindrical lens 33, a polygon mirror 34, a spherical lens 35, and a toroidal lens 36. The spherical lens 35 and toroidal lens 36 constitute an F-Theta lens. By rotating the polygon mirror 34, the laser radiator 37 can change a converging point of the laser beam in a direction in which the antenna 4 extends. When an electromagnetic wave is supplied to the antenna 4 from the electromagnetic wave oscillator 21, the laser radiator 37 sequentially converges the laser beam at the three strong electric field regions and generates plasmas. In this manner, the plasmas generated at the respective strong electric field regions absorb energy from electromagnetic waves and enlarge with different timings.

It is possible to provide a drive mechanism (drive unit) that moves a middle portion 4*b* of the antenna 4 into and out of a base portion 4*a* as well as moving a tip portion 4*c* of the antenna 4 into and out of the middle portion 4*b* of the antenna 4 so that the antenna 4 can be changed in length, when an electromagnetic wave is supplied to the antenna 4 from the electromagnetic wave oscillator 21. In such a case, since the locations of strong electric field regions are changed around the antenna 4, it becomes possible to generate electromagnetic wave plasmas at various locations by converging the laser beam at the respective strong electric field regions.

<Other Embodiments >

The embodiments described above may also be configured as follows.

In the embodiments described above, the plasma generation device may be applied to a surface modification device that modifies a surface of a member such as resin, for example.

Furthermore, though it has been described in the aforementioned embodiments that the timing to start oscillating an electromagnetic wave is before plasma is generated by the plasma generation device, the timing may be after the plasma is generated by the plasma generation device so long as the timing is before the small-scale plasmas are extinguished.

Furthermore, in the embodiments described above, the antenna 4 may be shaped like a rod of a uniform diameter having no diameter changeable portions. Even in such a case, a plurality of strong electric field regions can be formed around the antenna 4, if the length of the antenna 4 is configured such that a standing wave having a plurality of antinodes is formed on the antenna 4 when an electromagnetic wave is supplied to the antenna 4.

EXPLANATION OF REFERENCE NUMERALS

1 gas treatment device (plasma generation device)

1A gas treatment device

1B gas treatment device

2 plasma generators (ionization unit, electric dischargers)

3 electromagnetic wave radiator

4 antenna

5 flexure portions (diameter changeable portions)

10 duct (exhaust air duct)

11 draft chamber

12 external treatment device

20 reaction chamber

21 electromagnetic wave oscillator

The invention claimed is:

1. A plasma generation device, comprising:

an ionization unit that ionizes gas in a target space;

an electromagnetic wave oscillator that oscillates an electromagnetic wave to be radiated to the target space; and an antenna that radiates the electromagnetic wave supplied from the electromagnetic wave oscillator to a gas ionization region in which gas ionized by the ionization unit is provided, in which the ionization unit ionizes gas and the antenna radiates the electromagnetic wave thereto to generate plasma, wherein a plurality of strong electric field regions are formed around the antenna when the electromagnetic wave is supplied from the electromagnetic wave oscillator, the strong electric field region being a region stronger in electric field than the surrounding area, the ionization unit ionizes gas around the plurality of strong electric field regions, or gas around a plurality of regions in which immediately before strong electric fields come into existence, and the ionization unit comprises a plurality of electric dischargers, disposed corresponding to the plurality of strong electric field regions or the plurality of regions in which immediately before strong electric fields come into existence, and discharges around the regions.

2. A plasma generation device as set forth in claim 1, wherein the antenna is formed with a plurality of changeable portions changeable in at least one of shape or dimension, and a strong electric field region is formed in the vicinity of the changeable portions.

3. A plasma generation device as set forth in claim 2, wherein the antenna is in the form of a rod shape formed with a plurality of flexure portions as the changeable portions.

4. A plasma generation device as set forth in claim 2, wherein the antenna is a rod-shaped antenna formed with a plurality of diameter changeable portions as the changeable portions.

5. A plasma generation device as set forth in claim 2, wherein a distance between adjacent changeable portions is within a range from an approximately ½ to an approximately ¾ wave length of the electromagnetic wave in the antenna.

6. A plasma generation device as set forth in claim 3, wherein the antenna is formed in a square wave shape.

7. A plasma generation device as set forth in claim 6, wherein a plurality of the antennas are arranged, and flexure portions of respective antennas are shifted out of alignment from one another in the direction in which square waves run.

8. A plasma generation device as set forth in claim 1, wherein the ionization unit delays timing of discharging among the plurality of electric dischargers.

9. A plasma generation device as set forth in claim 1, further comprising a drive unit that moves the antenna.

* * * * *